United States Patent [19]

Brunetti et al.

[11] Patent Number: 4,932,320

[45] Date of Patent: Jun. 12, 1990

[54] METHOD AND DEVICE FOR REGISTERING COLORS IN AN OFFSET ROTARY PRESS

[76] Inventors: Michel Brunetti, 35 rue de l'Etang, F-78000 Versailles; Jean-Claude Holstein, 3 Mail des Tuyas, Residence Pas du Lac, F-78190 Montigny, Le Bretonneux; Alain Brunet, 145 impasse de la Voie Romaine; Jean D. Borras, 51, Grande rue Jean Moulin, both of 34000 Montpellier, all of France

[21] Appl. No.: 228,122

[22] Filed: Aug. 4, 1988

Related U.S. Application Data

[63] Continuation-in-part of Ser. No. 935,231, filed as PCT FR86/00074 on Mar. 7, 1986, published as WO86/05141 on Sep. 12, 1986, abandoned.

[30] Foreign Application Priority Data

Mar. 8, 1985 [FR] France ..... 85 03464

[51] Int. Cl.[5] ..... B41F 5/08; B41F 13/12

[52] U.S. Cl. ..... 101/181; 101/211

[58] Field of Search ..... 101/181, 248; 226/28–33, 2; 364/469, 468, 471; 250/548, 561, 571; 318/640; 356/399, 400, 401

[56] References Cited

FOREIGN PATENT DOCUMENTS 0123305 10/1984 European Pat. Off. .
127831 12/1984 European Pat. Off. .
0177885 4/1986 European Pat. Off. .

*Primary Examiner*—J. Reed Fisher
*Attorney, Agent, or Firm*—Dennison, Meserole, Pollack & Scheiner

[57] ABSTRACT

System for positioning objects relative to one another comprising taking an image of a group of marks formed on the medium, an analog-to-digital converter connecting the image-taking equipment to digital recording memories, and a data processing system for limiting the recorded image to a scan window including a fixed reference point corresponding to a predetermined mark for centering the image in the scan window for measuring the separations relative to two perpendicular axes between the reference point and the positions of the corresponding marks in the scan window, and for generating separation correction signals for displacing the objects.

16 Claims, 5 Drawing Sheets

METHOD AND DEVICE FOR REGISTERING COLORS IN AN OFFSET ROTARY PRESS

This is a continuation-in-part application of application Ser. No. 935,231, filed as PCT FR86/00074 on Mar. 7, 1986, published as WO86/05141 on Sep. 12, 1986, now abandoned.

FIELD OF THE INVENTION

The invention relates to a method and to a device for positioning objects relative to one another, and is applicable, in particular to printing on paper in an offset rotary press.

BACKGROUND OF THE INVENTION

Four-color printing on paper in an offset rotary press is based on the principle of superposing, on the paper, four printed images each of which is in a primary color (black, blue, yellow, red). The paper runs under four print rolls, each of which carries a plate or the like fixed to the roll in a disposition which iu accurately determined and prints an image on the paper in one of the primary colors. All four images must be exactly superposed in order to ensure the colors are in register relative to one another. The print rolls are equipped with motors for displacing them in two perpendicular directions (rotary displacement about the roll axis, and transversal displacement along said axis), with the positions of the rolls generally being adjusted and trimmed relative to the black ink print roll.

When performing simultaneous recto-verso printing, the paper runs through successive groups of pairs of print rolls which are both associated with the same primary color, with the theory of printing on each face of the paper being the same as explained above. When very high quality printing is required, it is desirable to ensure that the frames of the images printed on both sides of the paper are in register relative to each other through the paper, and in general this requires the position of the roll for printing the black color on the verso face to be adjusted relative to the position of the roll for printing the same color on the recto face.

Methods and devices for automatically adjusting color superposition are already known in which a visible mark is printed on the paper by each roll in the vicinity of the printed image in a zone which will be removed when the paper is cut on leaving the rotary press.

Means are provided for successively detecting the positions of these marks on the paper, for determining the errors in the positions of these marks relative to one another, and for producing control signals for the print roll displacement motors tending to reduce and eliminate the positioning errors of the marks, thereby obtaining exact superposition of the colors. However, the marks formed on the paper are of relatively large size, and this means that they are not always completely eliminated when the paper is cut. Further, the accuracy with which the marks can be detected is relatively limited. Finally, known methods and devices lead to the path of the paper being modified by the addition of extra rolls.

Also, it is important for the time taken by the various print roll position adjustments for obtaining good color superposition to be as small as possible. These adjustments are performed when the rotary press is rotating, and since the paper passes through the press at high speed (5 to 10 meters per second) the quantity of paper wasted during these adjustments is large and expensive.

Accordingly, it is the object of the present invention to reduce these various drawbacks to a considerable extent, by virtue of a method and a device enabling print rolls to be positioned relative to one another rapidly and accurately.

It is a particular object of the invention to reduce the time taken for adjusting the superposition of color in an offset rotary press.

It is a further particular object of the invention to increase the accuracy of adjustment of print rolls in an offset rotary press.

It is a still further object of the invention to reduce the quantity of paper wasted during the adjustment process of print rolls in an offset rotary press.

SUMMARY OF THE INVENTION

The present invention proposes a method and apparatus for positioning objects relative to one another, in particular color print rolls in an offset rotary press. The method consists in providing a positioning reference for the positioning in a plane of each object, in forming a visible mark on a medium parallel to said plane, in detecting the positions of the marks on the medium, in comparing the positions to each other in order to calculate errors, and in displacing the objects relative to one another along two perpendicular axes in said plane to reduce and cancel said errors. The invention is characterized in that the method comprises taking an image of a group of marks formed on the medium, in subjecting said image to analog-to-digital conversion, in limiting said digitized image to a scan window containing a reference point attributed to one of the marks on the medium, which mark is arbitrarily chosen as the reference mark, in centering the scan window on the image by superposing said reference point on said reference mark, in determining the separations between each mark other than the reference mark and the above-specified reference point relative to two axes parallel to the axes of object displacement, and in activating actuators to displace the objects along said axes to make said separations equal to theoretical values.

By virtue of the detection of the marks formed on the medium, and by virtue of the detected positions of the marks being processed digitally in order to determine the object displacement control signals, the invention allows these objects to be positioned relative to one another with a rapidity and a degree of accuracy which are much greater than those of the prior art.

In particular when the invention is applied to positioning print rolls in an offset rotary press, it enables the time required for the adjustments necessary for exactly superposing the colors to be reduced to a few tens of seconds, thereby limiting the quantity of paper wasted during these adjustments.

According to another characteristic of the invention, the accuracy of these adjustments is further improved by determining the centers of gravity of the images of the marks and by calculating the separations between these centers of gravity and the above-specified reference point of the scan window prior to making these separations equal to the predetermined theoretical values.

According to yet another characteristic of the invention, the method comprises taking instantaneous images of a predetermined number of successive groups of marks formed on the medium, in determining the positions of the centers of gravity of the images of the marks, and in verifying the shapes of the images of the marks and the coherence of the positions of the centers of gravity prior to calculating or not calculating the above-specified separations on the basis of the average values of the positions of the centers of gravity.

This serves to avoid taking a defect or a spot on the medium into account as a mark, to avoid taking account of an accidental deformation of a mark, or to avoid taking account of any other corresponding defect.

According to yet another characteristic of the invention, two position references are provided on each object, thereby forming two marks which are distant from each other on the medium, and in that the divergence between a straight line passing through the two marks and a reference straight line corresponding to the displacement axis of the medium is detected.

It is thus possible to detect when one object is positioned skew relative to the others.

According to yet another characteristic of the invention, applicable in particular to simultaneous recto-verso printing, the medium lies between two sets of the above-specified objects and has groups of marks formed on each of its two faces, in that the positions of at least one mark on one face of the medium and the corresponding mark on the other face of the medium are detected, and in that one of the two corresponding objects situated on opposite sides of the medium is displaced in order to align said two marks through the medium.

It is thus possible to ensure that the frames of images printed on both faces of a sheet or strip of paper are superposed.

The invention also provides an apparatus for positioning objects relative to one another, in particular rolls for printing colors in an offset rotary press, said objects including positioning references for positioning in a plane, which references form marks on a medium parallel to said plane, the apparatus including a detection system for detecting said marks, a data processor system for calculating the separations between the positions of the marks and theoretical positions and motors for controlling displacement of the objects each along two axes perpendicular to the plane. The device being further characterized in that the detection system comprises one or more video cameras for taking an image of a group of marks formed on the medium, an analog-to-digital converter connecting said video cameras to digital recording memories (e.g., RAM), and a data processing system for limiting the recorded image to a scan window including a fixed reference point corresponding to a predetermined mark, for centering the image in the scan window, for measuring the separations relative to two perpendicular axes, between the reference point and the positions of the marks in the scan window, and for generating separation modifying signals which are applied to control motors for displacing the objects.

The imaging cameras and a corresponding source of illumination may be fixed to external supports and thus do not require the rolling path of the press to be modified.

Advantageously, the data processor system includes program means for calculating the center of gravity of the images of the marks and for determining the positions of said centers of gravity relative to the reference point of the scan window.

Preferably, each video camera comprises a matrix camera of the charge coupled device (C.C.D) type, provided, for example, with an objective lens of variable focal length.

In order to improve accuracy, this camera may be associated with a stroboscope for taking still images of a medium running at high speed.

When printing simultaneously on both faces of the medium, the present invention includes two identical cameras for taking instantaneous images, disposed on either side of the medium, said cameras being connected to the same data processor system. The data processor system being suitable for determining the separation between a mark formed on one face of the medium and a corresponding mark formed on the other face of said medium, and for producing a signal for controlling object displacement to cancel said separation.

DESCRIPTION OF THE DRAWINGS

In the following description, which is given by way of example, reference is made to the accompanying drawings, in which.

DETAILED DESCRIPTION OF THE INVENTION

Figure 1:
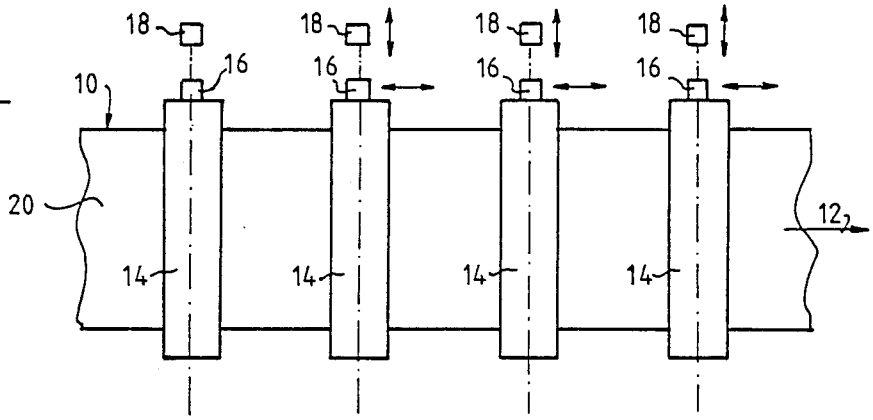
FIG. 1 is a highly simplified plan view of an offset rotary press.
Figure 2:
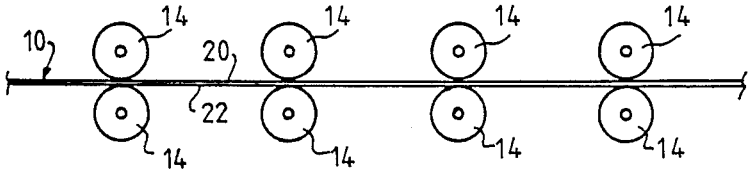
FIG. 2 is an elevation view of said press.

Reference is made initially to FIGS. 1 and 2 which show in highly diagrammatic and simplified form an offset rotary press for recto-verso printing on a strip of paper 10 which is unwound from a reel (not shown) and which moves in the direction indicated by arrow 12 at a relatively high speed, generally lying in the range 5 to 10 meters per second.

When performing four-color printing, the rotary press comprises four groups of pairs of print rolls 14 having horizontal axes extending perpendicularly to the direction 12 in which the strip of paper moves. These rolls 14 are grouped in pairs by being vertically superposed relative to each other with the various groups of rolls being separate from one another along the direction of paper movement. Each roll 14 supports a plate bearing the image to be printed in one of the four primary colors. For example, the leftmost rolls 14 in FIGS. 1 and 2 are intended for printing in black, whereas the following rolls print in blue, red, and yellow. Additional pairs of rolls may be provided for printing in special colors, for example, gold, silver, etc.

As mentioned above, the images printed by the various rolls on the strip of paper 10 must be superposed exactly in order to ensure that the colors are in register relative to one another. Although the plates are positioned and fixed on the rolls with great care, in a manner which need not be described herein, it is inevitable that additional position adjustments will need to be performed in order to exactly superpose the printed images. In order to do this, the rolls 14 are provided with means for displacing them in a plane parallel to the plane of the moving strip of paper 10 along two perpendicular axes which are shown diagrammatically in FIG. 1, one of which axes is parallel to the direction of paper movement and the other of which is parallel to the axes of the rolls 14. The rolls 14 are displaced along these two axes by pairs of electric motors 16 and 18, for example, three-phase asynchronous motors, with the motor 16 providing angular positioning of a roll 14 relative to the axis of its rotary drive shaft (which corresponds to the image printed by said roll being displaced along the axis 12 of paper strip movement), while the motor 18 displaces a roll 14 together with its drive shaft in the transverse direction.

The roll 14 for printing the color black on the recto face 20 of the strip of paper 10 serves, for example, as the reference roll, and consequently, its motors 16 and 18 for displacing it along the two perpendicular axes are not used.

Figure 3:
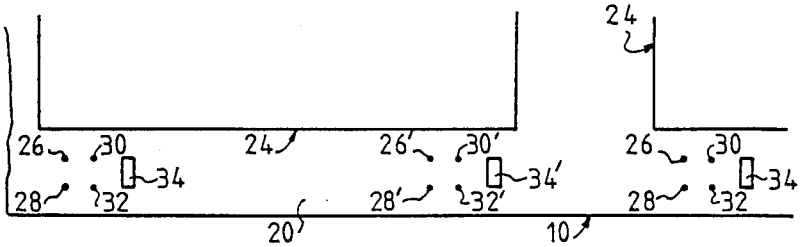
FIG. 3 shows a portion of a strip of paper printed by said press.

Reference is now made to FIG. 3 showing a recto portion 20 of the strip of paper 10 at the outlet from the print rolls 14. The recto face 20 thus bears a series of images 24 printed at regular intervals, with each image 24 being formed by the superposition of four images in the four primary colors. Between the longitudinal edge of an image 24 and the corresponding longitudinal edge of the strip of paper 10, there are four printed marks 26, 28, 30 and 32 which are preceded, in the direction of paper displacement, by a mark 34 such as a transverse bar of black color, for example.

In accordance with the invention, the four marks 26, 28, 30 and 32 are points of small size, for example, having diameters of less than 1 mm, and they are grouped substantially as a square or a rectangle. Each point is printed by a different roll and is the image of a positioning reference provided on the plate fixed to the print roll in question. Thus, for example, the mark 26 is a black point, the mark 28 a blue point, the mark 30 a red point, and the mark 32 a yellow point, although the color of each point has no importance for the subsequent operations.

The positioning references formed on the plates and producing the marks 26, 28, 30 and 32 are disposed relative to one another on the plates in such a manner that the four marks are located at the four corners of a predetermined square or rectangle on the recto face of the paper strip when the four images of different colors are being printed in exact superposition. This square or rectangle may be relatively small in size, for example, it may be less than 1 cm in length and breadth.

Naturally, when performing simultaneous recto-verso printing on a single strip of paper, both faces of the strip of paper include the above marks 26, 28, 30 and 32 in the immediate vicinity of each printed image, but the marks need not necessarily be vertically juxtaposed through the thickness of the paper.

In another embodiment, the number of marks may be of six, when each printed image is formed by the superposition of six images in six different colors. The marks may be on a line parallel to the direction of paper movement.

Figure 4:
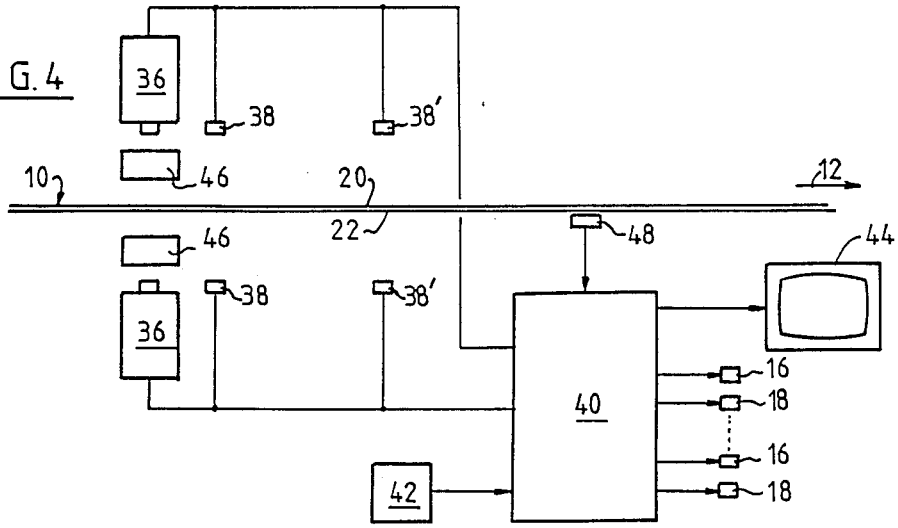
FIG. 4 is a diagram of a device in accordance with the invention applied to recto-verso printing on paper in a press of the type shown in FIGS. 1 and 2.

Reference is now made to FIG. 4 which is a diagram showing a device in accordance with the invention for positioning the print rolls in an offset rotary press performing simultaneous recto-verso printing.

The device is placed at the outlet from the press downstream from the print rolls in the direction of paper movement and upstream from the means for cutting the paper.

The device essentially comprises: two cameras 36 which are, for example, vertically aligned and disposed on either side of the strip of paper 10; two photoelectric cells 38 for triggering the cameras 36; data processing system 40; a keyboard 42 or analogous means for entering data into the processor system 40; and a video display screen 44.

The cameras 36 are matrix cameras of the C.C.D. type having their outputs connected via analog-to-digital converter 70 to recording memories of the data processor system 40. C.C.D. linear cameras could also be used instead of matrix cameras.

Preferably, a stroboscope 46 is provided between the objective lens of each camera 36 and the strip of paper 10 moving past said lens so that the camera can take an instantaneous still image of the group of four printed marks 26, 28, 30, and 32 moving past the lens.

The operation of the camera for taking an image of a group of marks is under the control of the trigger cell 38 which detects the passage of the special marks 34 printed ahead of each group of four marks 26, 28, 30, and 32. The operation of the trigger cell 38 may itself be authorized solely at regular intervals, for example, by using an output signal from a coding wheel 48 which is generally fitted to an offset rotary press and which is used to ensure that the strip of paper 10 is cut very accurately. The pulses provided by the coding wheel 48 are, for example, counted by a counter forming a part of the processor means 40 and which serve to authorize operation of the cell 38 each time a predetermined number of pulses has been counted.

Figure 7:
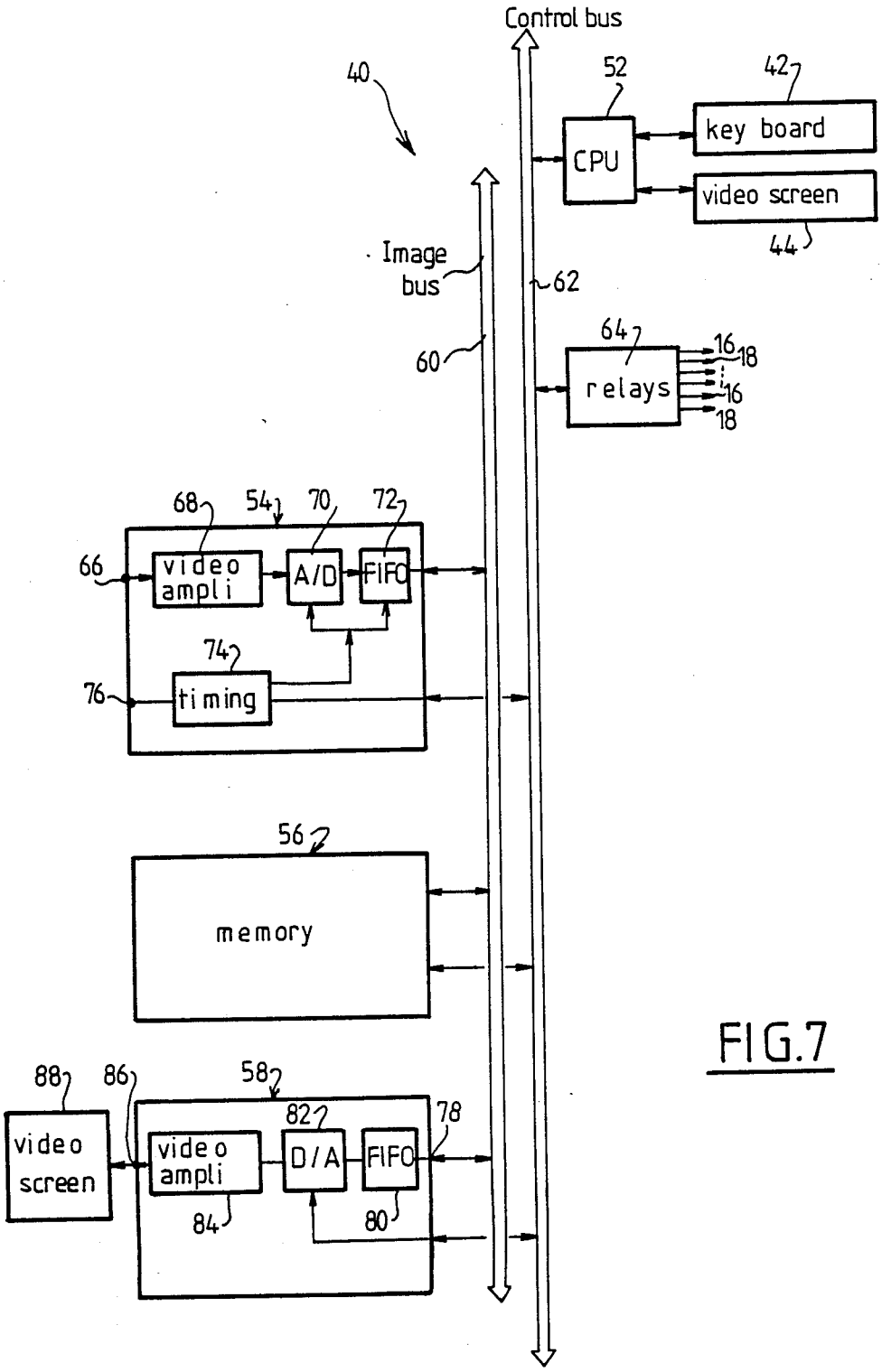
FIG. 7 depicts the data processor system used for performing calculations, image digitizing, communications, and control in the device of FIG. 4 in accordance with the invention.

An embodiment of the processor system 40 is shown in FIG. 7. The processor system 40 comprises a central processing unit (CPU) 52, an acquisition card 54, a memory card 56, a display card 58, an image data bus 60 connecting the said cards 54, 56 and 58 together, and a control signal bus 62 connecting the CPU 52 to the cards 54, 56, 58.

The CPU 52 is further connected to the keyboard 42 and the video screen 44, and is connected to the various electric motors 16, 18 by the bus 62 and relays 64.

The acquisition card 54 comprises an input 66 connecting the output of the C.C.D. camera 36 to a video amplifier 68. The output of this amplifier is connected to the image bus 60 by an analog-to-digital converter 70 and a FIFO (first-in first-out) memory 72. The card 56 further comprises a timing circuit 74 controlled by the CPU 52 via the bus 62 and connected to the analog-to-digital converter 70 and the FIFO register 72, and to a timing circuit (not shown) of the C.C.D. camera 36 via the output 76 of the card 54.

The digitized signals produced by the camera 36 and the converter 70 are stored in the memory 56 and are then processed by the CPU. The memory 56 may have e.g. a capacity of 256 kilobytes.

The display card 58 comprises an input 78 connecting the bus 60 to a FIFO memory 80, followed by a digital-to-analog converter 82 and a video amplifier 84.

The output of the amplifier 84 is connected to a video screen 88 by an output 86 of the display card 58, so that the images of the printed marks 26, 28, 30, 32 may be displayed on this video screen.

The main components of the system according to the invention are readily commercially available. For example, the camera 36 may be u C.C.D. matrix or linear camera, such as a Fairschild C.C.D. 3002; the processor system 40 may be a micro-computer system such as an IBM-PC or the like, and the various cards 54, 56, 58 associated with the camera are constituted of simple analog and digital logic (e.g., video circuits amplifier, A/D converter, timing logic, FIFO register) which are well known by anyone skilled in the art.

The method in accordance with the invention and the operation of the device shown in FIG. 4 are now described with reference to FIGS. 5 and 6.

Figure 5:
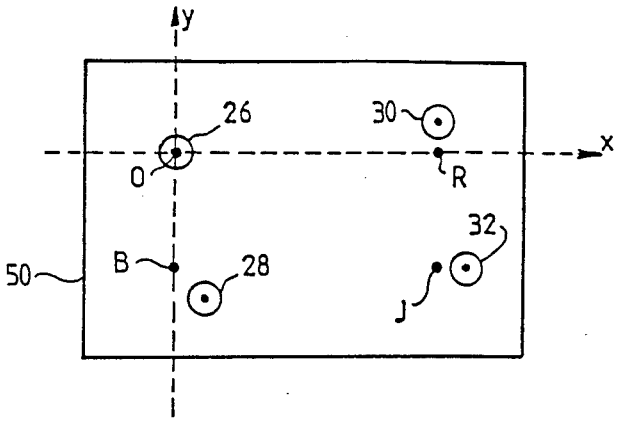
FIG. 5 shows the positioning of the images of the printed marks in a scan window.
Figure 6:
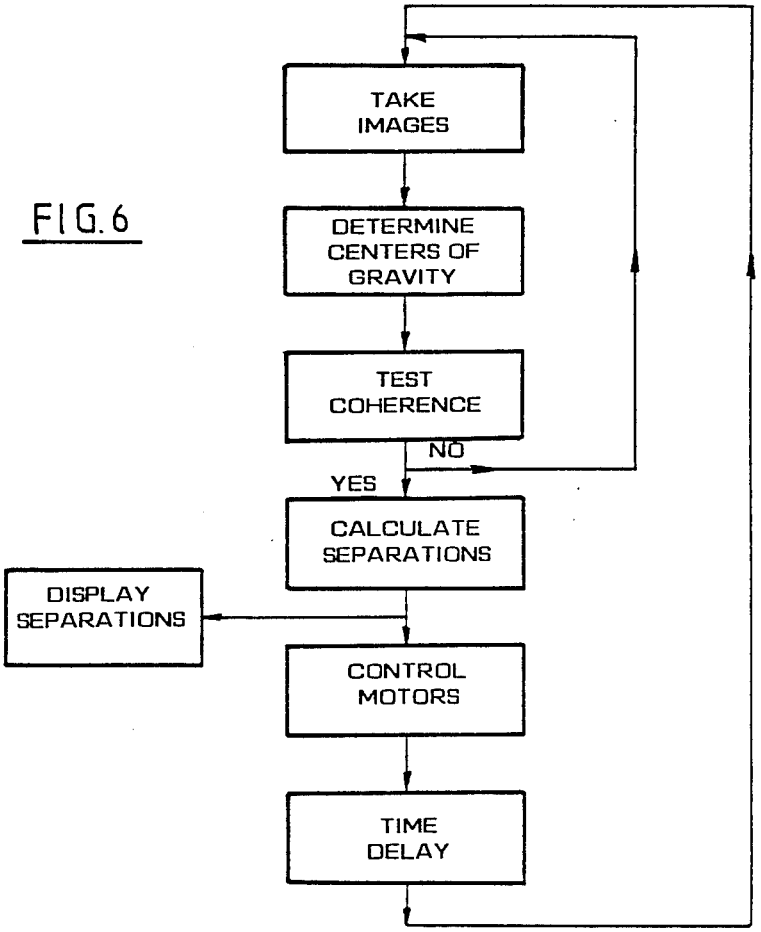
FIG. 6 is a flow chart showing the essential stages of the method in accordance with the invention.

The video image of the four printed marks 26, 28, 30, and 32 taken by a camera 36 and recorded in digital form in the memories of the processor means 40 is limited to a scan window which is shown diagrammatically in FIG. 5 and which has a predetermined format comprising, for example, about 480 scan points per line and about 360 scan points per column. The scan window 50 comprises a reference point 0 through which there pass two perpendicular reference axes x and y which correspond to the axes for displacing the rolls 14.

The scan window 50 is initially centered on the image of the four marks 26, 28, 30, and 32 by superposing the reference point 0 and the center (or center of gravity) of the image of the mark 26 formed on the paper by the roll 14 for printing in black.

In the scan window 50, the points B, R and J represent the theoretical positions which the centers of gravity of the images of the marks 28, 30 and 32 ought to occupy when the images printed on the paper in the four primary colors are perfectly superposed.

The method in accordance with the invention consists in determining the centers of gravity of the images of the marks 26, 28, 30, and 32, in superposing the center of gravity of the image of the mark 26 on the reference point 0, in determining the co-ordinates relative to the axes x and y of the centers of gravity of the images of the marks 28, 30, and 32, and in determining the separations between said centers of gravity and the points B, R, and J, respectively. Once these separations have been determined, the data processor system 40 determines the signals which are to be applied to relays 64 for controlling the motors 16 and 18 of the various rolls 14 in order to reduce and eliminate said separations.

Preferably, a certain number of images of groups of marks 26, 28, 30, and 32 are taken as they pass the camera lens, the centers of gravity of the images of the marks are determined, then the shapes of the images of the marks and the positions determined for their centers of gravity are subjected to a coherence test in order to avoid taking account of defects, such as spots on the paper, and if the results of the test are satisfactory, the separations are calculated on the basis of the average values of the positions of the centers of gravity of the images of the marks. The signals for correcting the positions of the rolls 14 as generated by the data processor system 40 are applied to the motors 16 and 18 for displacing the rolls, and then after a predetermined time interval, the above operations are repeated in order to verify that the images printed on the strip of paper by the various rolls 14 are indeed properly superposed.

The various steps of the method according to the invention are described below in a more detailed manner with reference to FIG. 8. These steps correspond to the main steps of a data processing program which is stored in the memory of CPU 52 and executed to automatically carry out the method according to the invention. An exemplary assembly language program and motor control subroutines are provided in Appendix A. The main program permits the checking of the position of six printed marks on a same line, the calculating of the mean values of the centers of gravity of these marks, and the calling of various calculation, display, and motor control subroutines.

Figure 8:
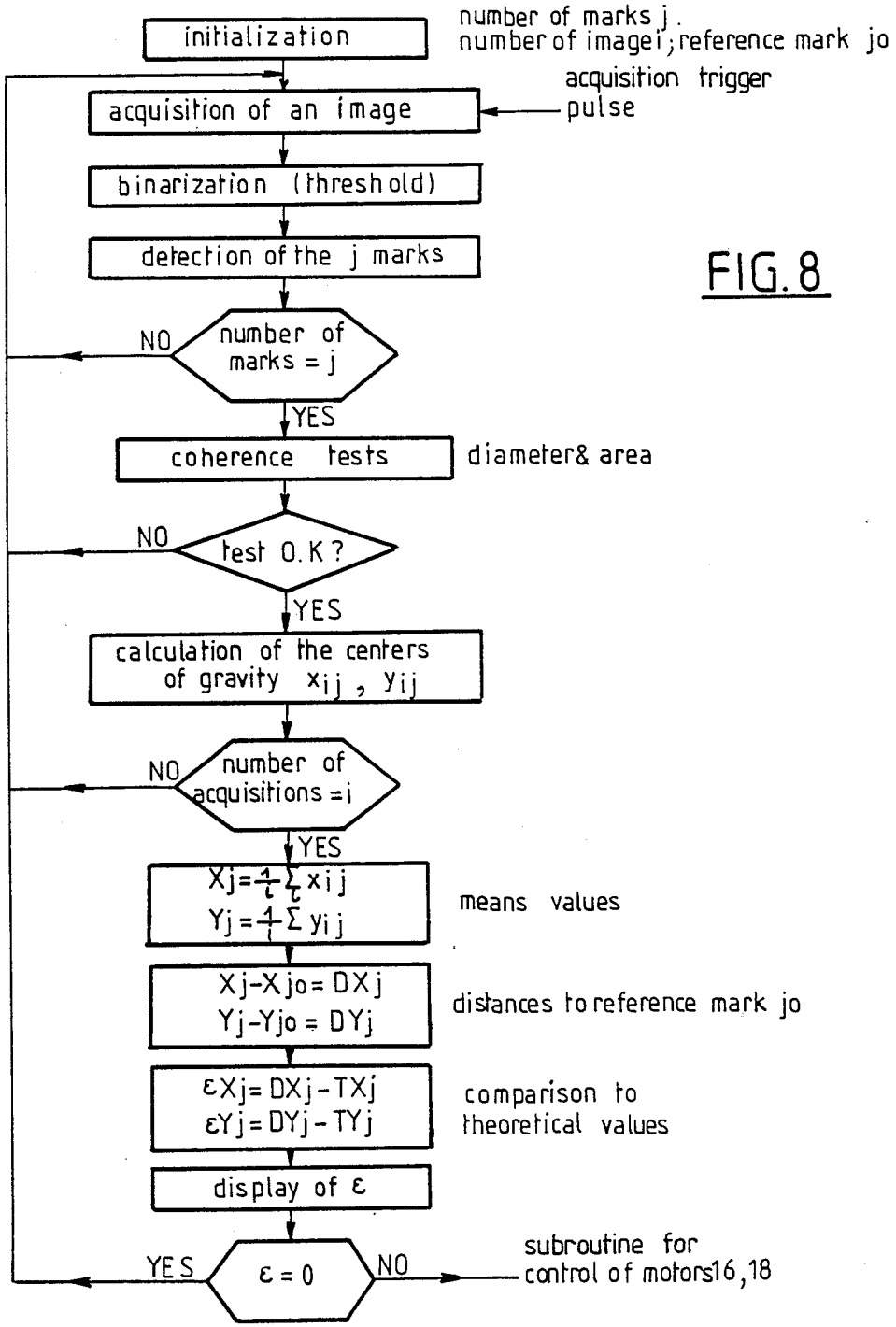
FIG. 8 depicts a flow diagram of the steps of the method of the invention performed by the data processor system of FIG. 7.

As shown in FIG. 8, the first step is an initialization of the number of printed marks to be detected (for example, 4 or 6) the number of images used of calculating the mean positions of the centers of gravity of the images of the marks, and, of course, the mark which is chosen as reference mark (corresponding, for example, to the color black). This initialization is made by the operator on keyboard 42.

The following step is the acquisition of an image by the video camera 36. The camera is triggered by a pulse produced either by the associated cell 38 or by a coding wheel already existing on the offset printing machines. The acquisition consists in taking an image, digitizing the image and storing it in a memory.

The following step is a binarization of the various points of the image taken by the camera: each signal produced from a C.C.D. diode of the camera is compared with a threshold and is considered as a white point if its grey level is under the threshold or as a black point if its grey level is above the threshold. In this manner, the images of the four or six printed marks are processed as though they were four or six black points and the above-mentioned scan window 50 contained only four or six black points.

The following step consists in searching and locating these points within the scan window. This search is made by scanning the lines of the scan window. A test on the number of located points is then made. If this number is equal to the number previously given by the operator, the process may continue. If it is different, the image is refused and another image is taken by the camera.

The following step is a coherence test concerning, for example, the diameter and the area of the images of the printed marks. If the diameter and area of these images are within predetermined values, the process may continue.

The following step is the calculation of the positions of the centers of gravity of the images of the printed marks. These marks are preferably circles, so their centers of gravity are the centers of the circles.

A test is next made for the number of images taken by the camera. If this number is lower than the number previously given by the operator, additional images are taken until their number is equal to the predetermined number.

The mean values of the coordinates of the said centers are then determined, they are compared with the theoretical coordinates of printed marks corresponding to an exact superposition of the different colors in the printing press, and their differences or separations are obtained.

When the separations are determined, they can be displayed on the video screen 44. If these separations are not equal to zero, the electric motors 16, 18 are controlled and operate to reduce and cancel these separations.

Figure 9:
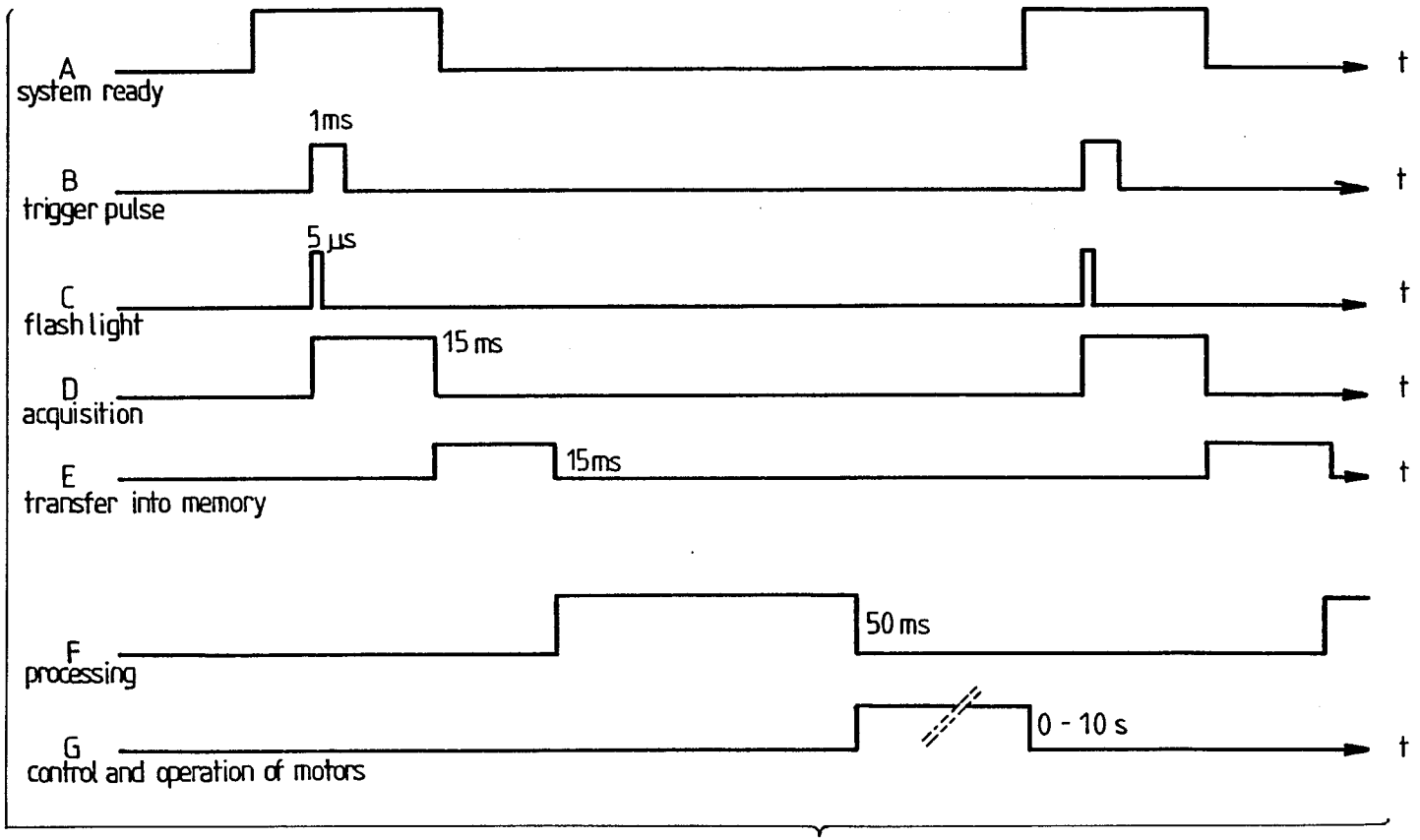
FIG. 9 depicts a relational timing diagram of the occurrence of the steps of the method of the invention with respect to the data processor system of FIG. 7.

A timing diagram of these various steps is shown in FIG. 9 in the case where only one image of the printed marks is processed at once. The first line A indicates that the system (and particularly the program) is ready for an acquisition. The second line B represents the triggering pulse produced by the cell 38 or the coding wheel of the printing press. The third line C represents the flash light produced by the stroboscope, having a duration of, for example 5 μs. The fourth line D is the acquisition by the video camera 36, which operates, for example, during a time interval of 15 ms corresponding to a typical control timing for a C.C.D. video camera. The transfer of the image into the memory takes about 15 ms (line E). The image processing (binarization, location of the images of the marks, etc.) takes about 50 ms (line F). The control and the operation of the electric motors 16, 18 (line G) may take approximately from 0 to 10 seconds. By comparing lines A, D and G, it can be seen that the system is ready again for a new acquisition at the end of the operation of the electric motors 16, 18.

This timing diagram corresponds to the processing of only one image of the printed marks. When several successive images are taken for calculating means values of the positions of the centers of gravity of the marks, line C comprises several successive acquisitions, and line E comprises several successive recordals into memory.

The video screen 44 is used for displaying the separations as calculated by the processor system 40. Also, the keyboard or the like 42 serves to enable an operator to modify the separations between the theoretical positions of the marks (i.e., the positions of the theoretical points B, R, and J, relative to the point 0) whenever the operator considers that to be necessary in order to obtain better results, and/or in order to validate the measured separations after a first adjustment on the basis of the theoretical values for the separations in order to cause the validated separations to act as theoretical separations for the following operations.

Naturally, the data processor system 40 is of sufficient capacity to allow simultaneous adjustment of the superposition of the colors on both faces of the strip of paper 10, with these adjustments being independent from each other.

The device can also be used to adjust the relative positions or images printed on the recto and verso faces of the strip of paper. This can be done by ensuring the mark 26 printed on the recto face of the strip of paper 10 by the black ink print roll 14 has measured coordinates which are substantially equal to those of the corresponding mark 26 printed on the verso face. The data processor system 40 can be used to compare the positions of the centers of gravity of the images of the two marks 26 formed on the recto and the verso faces of the strip of paper and to calculate control signals for the motors 16 and 18 to displace the roll 14 for printing black on the verso face of the strip of paper. This allows the frames of images printed on the recto and verso faces of the paper to be aligned.

The method and apparatus in accordance with the invention can also be used to detect and display the skewness of a plate on a roll.

In order to do this, each plate fixed on a print roll 14 is provided, as shown in FIG. 3, with two positioning references, one near a first longitudinal end of the image to be printed and the other near the opposite longitudinal end of the image. One of these positioning references forms the above-described mark 26 on the paper (when printing in black) and the other positioning reference forms a mark 26' which is separated from the mark 26 in the direction of paper movement by a distance which iu of the same order as the length of the plate fixed on the print roll. Similarly, the plates fixed on the other print rolls can form marks 28', 30', and 32' on the paper and a transverse bar 34' may also be printed for triggering a photocell 38' controlling the taking of an image by the corresponding video camera 36.

In order to detect whether a plate is skew, a straight line passing through two points 26 and 26' corresponding to the same image 24 is verified to see whether it corresponds to a referenced straight line passing through the point 26, or whether it is at an angle thereto. The angle representing the skew may be measured and also displayed on the screen 44.

Tests have shown that the method and apparatus in accordance with the invention can reduce the time taken for adjusting the superposition of colors in an offset rotary press to a few tens of seconds, thereby reducing the quantity of paper which is wasted during the adjustment process. In addition, the adjustment is much more accurate than could be obtained previously. This accuracy may be increased as much as desired when the video camera used is provided with a variable focal length lens, and the marks 26, 28, 30, and 32 printed on the paper are close to one another.

The method and apparatus in accordance with the invention are not limited to adjusting the superposition of colors in an offset type press. For example, the method and apparatus also applicable to printing on cloth, and in general to positioning objects relative to one another whenever said objects are displaceable relative to one another in a plane.

Finally, the above-described embodiments are intended to be illustrative and exemplary only. Alternative embodiments may be desired by those skilled in the art without departing from the spirit and scope of the claims which follow.

We claim:

1. A method of registering colors on a strip of paper in an offset rotary press, said press having printing rolls and motor means for displacing the printing rolls along two perpendicular axes, each printing roll forming a printed image in a given color and a printed mark near the printed image on the strip of paper, so that a group of marks is printed near each printed image on the strip of paper, wherein each printed mark is a point and the method comprises the steps of: taking a video image of a said group of marks, digitizing said image, limiting the digitized image to a scan window, providing a reference point in said scan window, centering the scan window by superposing the reference point on the image of one mark of said group of marks, said mark being arbitrarily chosen as a reference mark, determining the separations between the reference point and the image of each mark other than the reference mark relative to two axes corresponding to the said perpendicular axes, and controlling the said motor means for displacing the printing rolls to make said separations equal to predetermined theoretical values.

2. A method according to claim 1, further including determining the centers of gravity of the images of the marks, superposing the reference point of the scan window on the center of gravity of the image of the reference mark, and determining the separations between this reference point and the centers of gravity of the images of the marks.

3. A method according to claim 1, further including taking images of a predetermined number of successive groups of marks printed on said strip of paper, determining the centers of gravity of the images of the marks, verifying the coherence of the positions of the said centers of gravity and the shapes of the images of the marks in the said images of the successive groups of marks, and determining average values for the positions of the centers of gravity and determining the said separations from these average values.

4. A method according to claim 1, further including forming another mark by means of each printing roll near each printed image on said strip of paper, so that both marks formed by the same printing roll are distant from each other on said strip of paper, and detecting a divergence between a straight line passing through said both marks and a reference straight line passing through a predetermined one of these marks.

5. A method according to claim 1, further including forming an additional mark on the strip of paper in the vicinity of each group of marks, and detecting this additional mark for controlling the taking of an image of the group of marks.

6. A method according to claim 1, for an offset rotary press in which the strip of paper lies between two sets of the said printing rolls and has sprinted images and printed groups of marks formed on each of its two faces, said method further including detecting the positions of at least one mark on one face of the strip of paper and a corresponding mark on the other face of the strip of paper, and in controlling the motor means for displacing at least one of the corresponding printing rolls in order to align said two marks through the strip of paper.

7. A method according to claim 1, wherein each printed mark has a diameter of less than 1 mm.

8. A device for registering colors on a strip of paper in an offset rotary press, this press comprising printing rolls and motor means for displacing the printing rolls along two perpendicular axes, each printing roll forming a printed image in a given color and a printed mark near the printed image on the strip of paper, so that a group of marks is printed near each printed image on the strip of paper, wherein each printed mark is a point and the device comprises video camera for taking an image of a said group of marks, an analog-to-digital converter, digital recording memories connected to the video camera by the said converter for recording the image of the group of marks, data processing means connected with said converter and said memories and said video camera, said processing means including means for limiting the digitized image to a scan window, means for providing a reference point, means for centering the scan window by superposing the reference point on the image of one mark of said group of marks, said one mark being arbitrarily chosen as a reference mark, means for determining the separations between the reference point and the image of each mark other than the said reference mark relative to two axes corresponding to the said perpendicular axes, and means for controlling the said motor means for displacing the printing rolls to make said separations equal to predetermined theoretical values.

9. A device according to claim 8, wherein the video camera is of the charge coupled lever type.

10. A device according to claim 9, wherein the video camera is a matrix camera.

11. A device according to claim 9, wherein the video camera is provided with an objective lens of variable focal length.

12. A device according to claim 9, comprising a stroboscope associated with the video camera for taking still images of the strip of paper running at high speed.

13. A device according to claim 8, further comprising means for controlling the taking of images by said video camera, said means comprising a photoelectric cell for detecting an additional mark formed in the vicinity of each group of marks on said strip of paper.

14. A device according to claim 13, further comprising means sensitive to the speed of the strip of paper for controlling said photoelectric cell and allowing it to operate at regular intervals.

15. A device according to claim 8, for an offset rotary press comprising printing rolls for printing simultaneously on both faces of a strip of paper, said device including two video cameras disposed on either side of the strip of paper, said cameras being connected to the same data processing means which is suitable for determining the separation between a mark on one face of the strip of paper and a corresponding mark on the other face of the strip of paper and for producing a control signal applied to the motor means to cancel said separation.

16. A device according to claim 8, further comprising keyboard means connected to the data processing means for enabling an operator to modify the values of the separations.

* * * * *